US007896327B2

(12) United States Patent
Lee et al.

(10) Patent No.: US 7,896,327 B2
(45) Date of Patent: Mar. 1, 2011

(54) POSITIONING MECHANISM FOR MAN-MADE EAR

(75) Inventors: Chao-Chien Lee, Taipei Hsien (TW); Po-Yu Lin, Taipei Hsien (TW); Chiu-Yi Wu, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 302 days.

(21) Appl. No.: 12/195,387

(22) Filed: Aug. 20, 2008

(65) Prior Publication Data

US 2009/0266959 A1 Oct. 29, 2009

(30) Foreign Application Priority Data

Apr. 25, 2008 (CN) ..... 2008 1 0301301

(51) Int. Cl.
*B25B 1/14* (2006.01)

(52) U.S. Cl. ..... 269/228; 269/91; 269/95

(58) Field of Classification Search ..... 248/121, 248/122.1, 124.1, 295.11, 296.1; 269/91, 269/95, 27, 32, 228
See application file for complete search history.

(56) References Cited

U.S. PATENT DOCUMENTS 2,124,006 A * 7/1938 Parker ..... 248/124.2
3,362,668 A * 1/1968 Reinhart ..... 248/125.1
3,367,612 A * 2/1968 Usiskin ..... 248/124.1
3,883,103 A * 5/1975 Bartolat ..... 248/124.1
4,050,661 A * 9/1977 Wooldridge ..... 248/285.1
2006/0073720 A1 4/2006 Lin et al.

* cited by examiner

*Primary Examiner*—A. Joseph Wujciak, III
(74) *Attorney, Agent, or Firm*—Frank R. Niranjan

(57) ABSTRACT

A positioning mechanism for a man-made ear includes a shaft, a driving device, a rotational arm, a first sliding member, and a second sliding member. The driving device is slidably secured to the shaft by a first fastener. The driving device also has a rotational wheel. The rotational arm has an end secured to the rotational wheel. The first sliding member has a first elongated sliding groove adjustably secured to the rotational arm by a second fastener inserted through the first elongated sliding groove. The second sliding member has one or more second elongated sliding grooves perpendicular to the first elongated sliding groove. The second sliding member is adjustably secured to the first sliding member by one or more third fasteners inserted through the one or more second elongated sliding grooves. The second sliding member is configured for securing a man-made ear.

6 Claims, 3 Drawing Sheets

POSITIONING MECHANISM FOR MAN-MADE EAR

BACKGROUND

1. Field of the Invention

The present invention relates to positioning mechanisms and, particularly, to a positioning mechanism for man-made ear.

2. Description of Related Art

Many electronic devices, such as speakers, require man-made ears during the process of sound testing. Man-made ears are usually secured on a positioning mechanism, which is located at a preset location and allows the man-made ears to move up and down. Conventional positioning mechanisms for man-made ears are usually designed corresponding to certain types of electronic devices. When the type of the electronic device to be tested is changed, for example, to have a larger size, the positioning mechanism should be redesigned. The preceding scenario is a waste of time and money.

What is needed, therefore, is a positioning mechanism for a man-made ear that can adjust the position of the man-made ear in a large range.

SUMMARY

A positioning mechanism for a man-made ear includes a shaft, a driving device, a rotational arm, a first sliding member, and a second sliding member. The driving device is slidably secured to the shaft by a first fastener. The driving device also has a rotational wheel. The rotational arm has an end secured to the rotational wheel. The first sliding member has a first elongated sliding groove adjustably secured to the rotational arm by a second fastener inserted through the sliding groove. The second sliding member has one or more second elongated sliding grooves perpendicular to the first elongated sliding groove. The second sliding member is adjustably secured to the first sliding member by one or more third fasteners inserted through the second elongated sliding grooves. The second sliding member is configured for securing a man-made ear.

BRIEF DESCRIPTION OF THE DRAWINGS

Many aspects of the present positioning mechanism for man-made ears can be better understood with references to the following drawings. The components in the drawings are not necessarily drawn to scale, the emphasis instead being placed upon clearly illustrating the principles of the present positioning mechanism for man-made ears.

DETAILED DESCRIPTION

Embodiments of the present invention will now be described in detail below, with references to the drawings.

Figure 1:
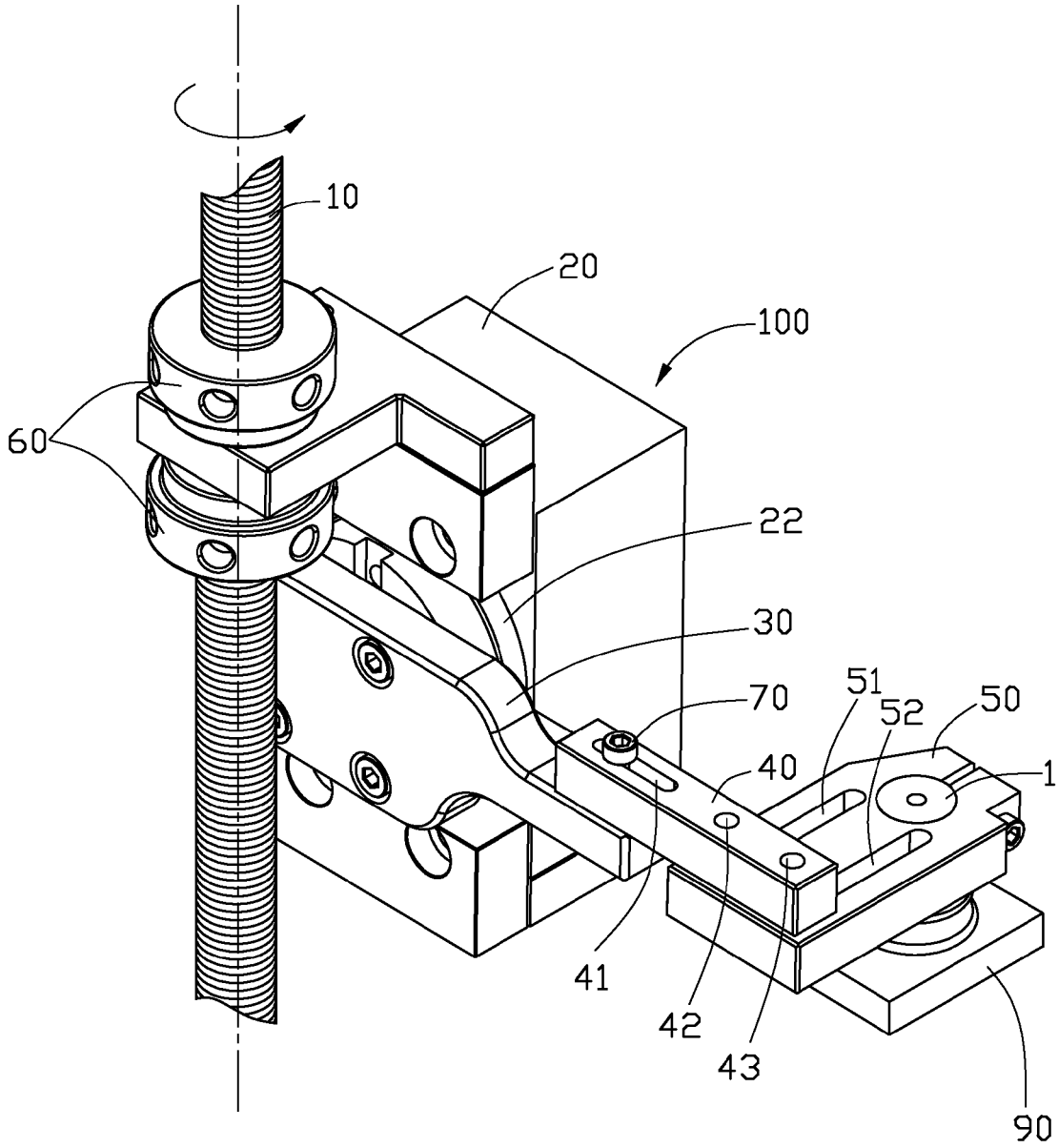
FIG. 1 is a schematic view of a positioning mechanism for a man-made ear operating according to a present embodiment.
Figure 2:
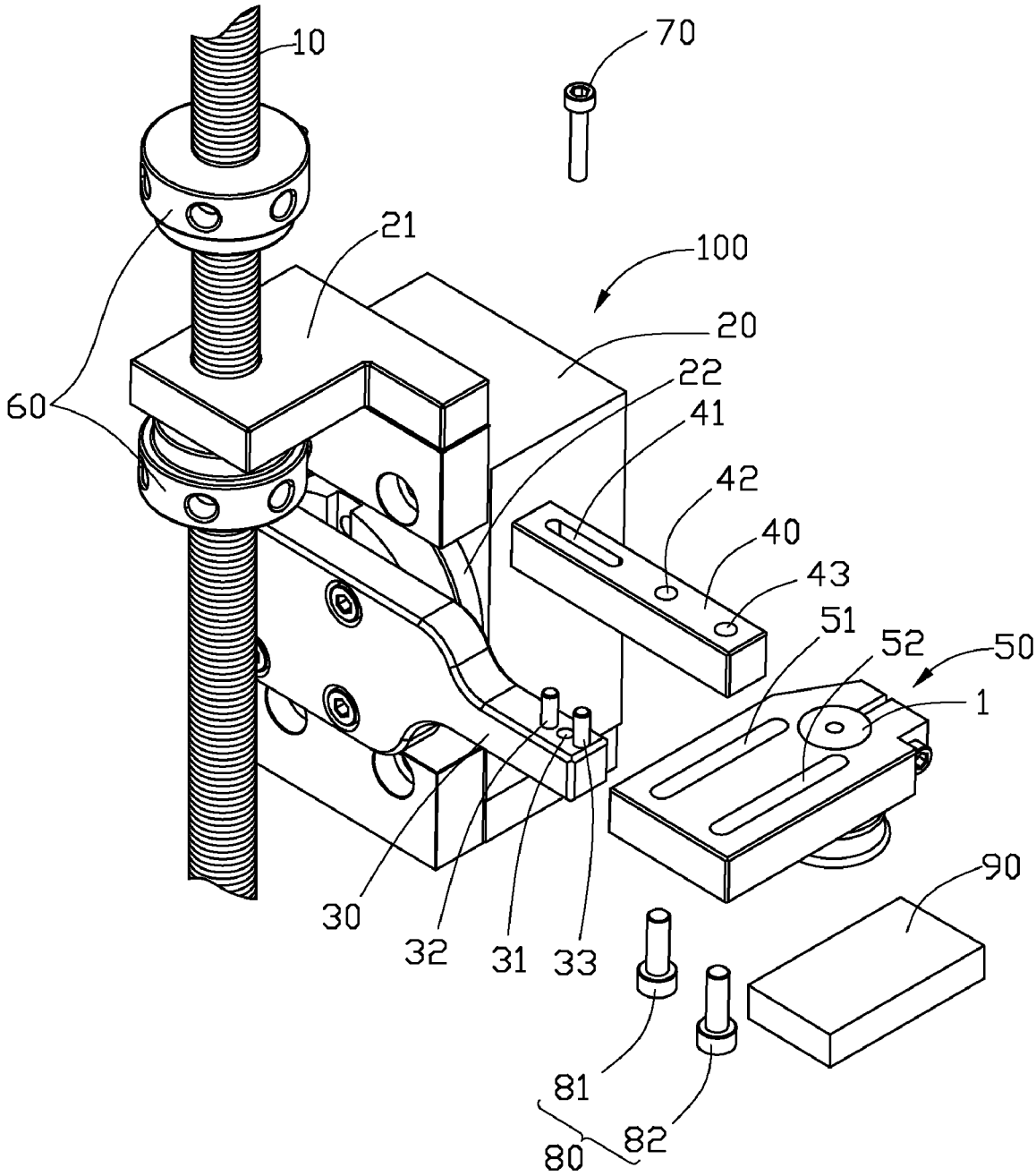
FIG. 2 is a partially exploded view of FIG. 1.
Figure 3:
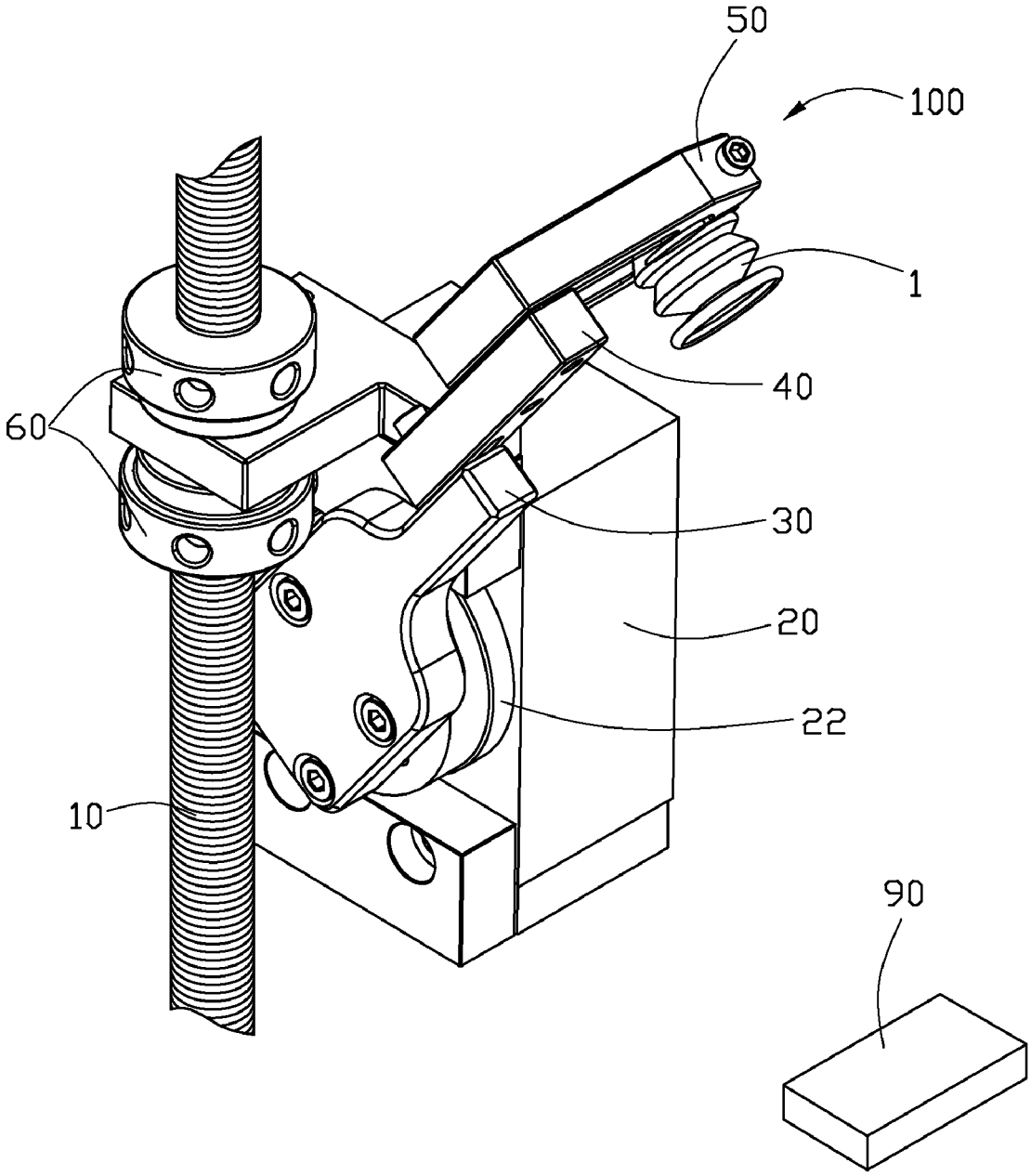
FIG. 3 is a schematic view of the positioning mechanism for a man-made ear of FIG. 1 in another operating state.

Referring to FIGS. 1 to 3, a positioning mechanism 100 according to an embodiment includes a shaft 10, a driving device 20, a rotational arm 30, a first sliding member 40, a second sliding member 50, a first fastener 60, a second fastener 70, and a third fastener 80.

The driving device 20 has a securing portion 21 secured on the shaft 10 by the first fastener 60. Loosening of the first fastener 60 allows the driving device 20 to move along and rotate about the shaft 10, and tightening of the first fastener 60 fixes the driving device 20 in a new position. The driving device 20 includes a rotatable wheel 22 that can rotate clockwise or counter-clockwise. In the present embodiment, the driving device 20 is a motor for rotating the rotatable wheel 22.

A first end of the rotational arm 30 is secured on the rotatable wheel 22 so that the rotational arm 30 can rotate along with the rotatable wheel 22. A second end of the rotational arm 30 opposite to the first end is connected with an end of the first sliding member 40. In the present embodiment, the rotational arm 30 has two protruding posts 32, 33 and a screw hole 31 at the second end.

The first sliding member 40 has an elongated sliding groove 41 at the end thereof near the rotational arm 30 and two screw holes 42, 43 at another end thereof away from the rotational arm 30. The sliding groove 41 is configured for receiving the protruding post 32 and 33 of the rotational arm 30. The first sliding member 40 can be secured to the rotational arm 30 by the second fastener 70. In the present embodiment, the second fastener 70 is a screw that runs through the sliding groove 41 and engages in the screw hole 31 to secure the first sliding member 40 to the rotational arm 30. Loosening of the second fastener 70 allows the first sliding member 40 to slide on the second fastener 70, and tightening of the second fastener 70 fixes the first sliding member 40 in a new position.

The second sliding member 50 has two elongated sliding grooves 51, 52 at the end thereof near the first sliding member 40. The second sliding member 50 can be secured to the first sliding member 40 by the third fastener 80. A man-made ear 1 can be secured on another end of the second sliding member 50 away from the first sliding member 40 for testing an electronic device 90. In the present embodiment, the third fastener 80 includes two screws 81, 82. The second sliding member 50 can be secured to the first sliding member 40 via the two fastening screws 81, 82, by running the screws 81, 82 through the sliding grooves 51, 52 and engaging the screws 81, 82 into the two screw holes 42, 43, respectively. The sliding grooves 51, 52 of the second sliding member 50 are parallel to each other, and perpendicular to the sliding groove 42 of the first sliding member 40 after the second sliding member 50 is secured to the first sliding member 40. Loosening of the third fastener 80 allows the second sliding member 50 to slide on the third fastener 80, and tightening of the third fastener 80 fixes the second sliding member 50 in a new position.

The man-made ear 1 carried by the positioning mechanism 100 can move freely along with movements of the driving device 20, the rotational arm 30, and the first and second sliding members 40, 50. Therefore, when the type of the electronic device to be tested has been changed, the man-made ear 1 can easily match the new type by adjusting the positioning mechanism 100. Furthermore, as shown in FIG. 3, the rotational arm 30 can move up and down by rotating of the rotatable wheel 22.

While certain embodiments have been described and exemplified above, various other embodiments will be apparent to those skilled in the art from the foregoing disclosure. The present invention is not limited to the particular embodiments described and exemplified, but is capable of considerable variation and modification without departure from the scope of the appended claims.

What is claimed is:

1. A positioning mechanism for man-made ear comprising:

a shaft;

a driving device slidably secured to the shaft by a first fastener, the driving device also having a rotational wheel;

a rotational arm with an end secured to the rotational wheel;

a first sliding member having a first elongated sliding groove adjustably secured to the rotational arm by a second fastener inserted through the first elongated sliding groove; and a second sliding member with one or more second elongated sliding grooves being perpendicular to the first elongated sliding groove, the second sliding member being adjustably secured to the first sliding member by one or more third fasteners inserted through the one or more second elongated sliding grooves, the second sliding member configured for securing a man-made ear, wherein the driving device drives the rotational wheel to rotate the arm with the man-made ear up and down ear.

2. The positioning mechanism as claimed in claim 1, wherein the second fastener is a screw.

3. The positioning mechanism as claimed in claim 1, wherein the third fastener is a screw.

4. The positioning mechanism as claimed in claim 1, wherein the number of one or more second elongated sliding grooves is more than one, and the second sliding member is secured to the first sliding member by two third fasteners inserted through two of the second elongated sliding grooves.

5. The positioning mechanism as claimed in claim 1, wherein the rotational arm has one or more protruding posts received in the first elongated sliding groove.

6. The positioning mechanism as claimed in claim 1, wherein the driving device is a motor.

* * * * *